US010017715B2

(12) United States Patent
He et al.

(10) Patent No.: US 10,017,715 B2
(45) Date of Patent: Jul. 10, 2018

(54) FABRIC SOFTENER

(71) Applicant: RHODIA OPERATIONS, Paris (FR)

(72) Inventors: Lin He, Singapore (SG); Hai Zhou Zhang, Singapore (SG)

(73) Assignee: Rhodia Operations, Paris (FR)

( * ) Notice: Subject to any disclaimer, the term of this patent is extended or adjusted under 35 U.S.C. 154(b) by 0 days.

(21) Appl. No.: 14/767,808

(22) PCT Filed: Feb. 15, 2013

(86) PCT No.: PCT/EP2013/053099
§ 371 (c)(1),
(2) Date: Aug. 13, 2015

(87) PCT Pub. No.: WO2014/124688
PCT Pub. Date: Aug. 21, 2014

(65) Prior Publication Data
US 2016/0032219 A1 Feb. 4, 2016

(51) Int. Cl.
*C11D 1/90* (2006.01)
*C11D 3/00* (2006.01)

(52) U.S. Cl.
CPC ..... *C11D 3/001* (2013.01); *C11D 1/90* (2013.01); *C11D 3/0015* (2013.01)

(58) Field of Classification Search
CPC ..... C11D 1/90; C11D 1/94; C11D 3/001
See application file for complete search history.

(56) References Cited

U.S. PATENT DOCUMENTS

| | | | | |
|---|---|---|---|---|
| 4,360,437 | A | 11/1982 | Wolfes | |
| 4,486,195 | A | 12/1984 | Weinstein et al. | |
| 4,855,072 | A | 8/1989 | Trinh et al. | |
| 6,667,280 | B2 * | 12/2003 | Chang | C09K 8/74 507/240 |
| 2006/0084579 | A1 * | 4/2006 | Berger | C09K 8/12 507/129 |
| 2008/0200353 | A1 * | 8/2008 | Dahayanake | A61K 8/02 507/240 |
| 2010/0069269 | A1 * | 3/2010 | Prat | A61K 8/44 507/133 |
| 2014/0148372 | A1 * | 5/2014 | Man | C11D 1/75 510/407 |

FOREIGN PATENT DOCUMENTS

| | | | |
|---|---|---|---|
| EP | 0018039 | A1 | 10/1980 |
| EP | 0369500 | A2 | 5/1990 |
| JP | S5059572 | | 5/1975 |
| JP | S6096695 | | 5/1985 |
| JP | H4-153300 | | 5/1992 |
| JP | H11-350349 | | 12/1999 |
| JP | 2009506223 | | 2/2009 |
| WO | WO 9414935 | A1 | 7/1994 |
| WO | WO 97/42279 | A1 | 11/1997 |
| WO | WO 02072745 | A1 | 9/2002 |
| WO | WO 2004/044113 | A2 | 5/2004 |
| WO | 2007025657 | A1 | 3/2007 |

OTHER PUBLICATIONS

Mirataine BET-O-30 Product Data Sheet, Rhodia, Inc., Jul. 2007.*
Dauqan, Eqbal M.A., et al—"Fatty Acids Composition of Four Different Vegetable Oils (Red Palm Olein, Palm Olein, Corn Oil and Coconut Oil) by Gas Chromatography", 2011, 2011 2nd International Conference on Chemistry and Chemical Engineering, vol. 14, pp. 31-34, XP002696012; IACSIT Press, Singapore; 4 pgs.

* cited by examiner

*Primary Examiner* — John R Hardee

(57) ABSTRACT

The present invention concerns the use of a $C_{16}$-$C_{22}$-alkyl or $C_{16}$-$C_{22}$-alkenyl amido alkyl betaine derivatives as a fabric softener, notably for fabric softening compositions. The invention also concerns a method of treating fabric which comprises the step of contacting said fabric in the rinse cycle of a fabric washing machine with an aqueous medium containing a composition as defined herein.

9 Claims, No Drawings

FABRIC SOFTENER

The present invention concerns the use of a $C_{16}$-$C_{22}$-alkyl or $C_{16}$-$C_{22}$-alkenyl amido alkyl betaine derivatives as a fabric softener, notably for fabric softening compositions. The invention also concerns a method of treating fabric which comprises the step of contacting said fabric in the rinse cycle of a fabric washing machine with an aqueous medium containing a composition as defined herein.

PRIOR ART

Fabric care compositions deliver a number of desirable characteristics to fabrics upon treatment, including an improved fabric feel and a perception of freshness. However, in order to secure high consumer acceptance of any fabric care composition, it is essential to provide consumer-desirable product aesthetics, for example not only an appealing neat product odor and a pleasant product color, but especially an appropriate product rheology and satisfactory physical product stability.

Preferred fabric softener actives according to WO-A-02072745 are esterquats such as N,N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2-hydroxyethyl) N-methyl ammonium methylsulfate or 1,2-di(stearoyl-oxy)-3-trimethyl ammoniumpropane chloride.

There is an abundant bibliography on the subject of combining dialkyl substituted quaternary ammonium compounds and monoalkyl quaternary ammonium compounds, amongst which patents or patent applications EP-A-0018039, EP-A-0369500, U.S. Pat. No. 4,360,437 or U.S. Pat. No. 4,855,072 amongst many others, may be mentioned.

References describing mixtures of dialkyl substituted esterquats and monoalkyl esterquats are WO-A-9414935, WO-A-9742279, WO-A-20040644113 amongst many others.

INVENTION

The present invention is based on the surprising discovery that it is possible to obtain a stable fabric softener composition that performs well on softening fabrics, which comprises at least a compound of formula (I):

$$R^1\text{—}CONH(CH_2)_n\text{—}N^+(R^2R^3)\text{—}CH_2COO^- \quad (I)$$

Wherein:

$R^1$ is $C_{16}$-$C_{22}$-alkyl or $C_{16}$-$C_{22}$-alkenyl, $R^2$ and $R^3$ are independently $C_1$-$C_4$-alkyl, and n is a number between 1 and 3.

This compound indeed appears to be more efficient in term of softness, water absorbency and fluffiness in comparison with the compounds classically used in the softening compositions such as Cocoamidopropyl dimethyl betaine, di(hydrogenated tallow) dimethyl ammonium chloride and di(palmiticcarboxyethyl) hydroxyethyl methyl ammonium methylsulfate. These natural based compounds of the present invention are biodegradable and also provides a good ecotox profile. These compounds also provide the advantage to be translucent and transparent.

The present invention then concerns a softening composition comprising at least a fabric softener compound of formula (I):

$$R^1\text{—}CONH(CH_2)_n\text{—}N^+(R^2R^3)\text{—}CH_2COO^- \quad (I)$$

Wherein:

$R^1$ is $C_{16}$-$C_{22}$-alkyl or $C_{16}$-$C_{22}$-alkenyl, $R^2$ and $R^3$ are independently $C_1$-$C_4$-alkyl, and n is a number between 1 and 3.

The present invention also concerns the use of a compound of formula (I) as a fabric softener, notably for fabric softening compositions.

A fabric softener, or mixtures thereof, is an essential ingredient of the invention. Typical levels of the fabric softener within the softening compositions are 0.1% to 20% by weight, preferably from 1% to 15% by weight.

"Alkyl" as used herein means a straight chain or branched saturated aliphatic hydrocarbon.

"Alkenyl", as used herein, refers to an aliphatic group containing at least one double bond and is intended to include both "unsubstituted alkenyls" and "substituted alkenyls", the latter of which refers to alkenyl moieties having substituents replacing a hydrogen on one or more carbon atoms of the alkenyl group.

Preferably $R^1$ is $C_6$-$C_{22}$-alkyl, such as $C_{18}$-alkyl, $C_{20}$-alkyl, $C_{21}$-alkyl and $C_{22}$-alkyl. Preferably $R^1$ is $C_{16}$-$C_{22}$-alkenyl, such as $C_{18}$-alkenyl, $C_{20}$-alkenyl, $C_{21}$-alkenyl and $C_{22}$-alkenyl. Preferably $R^2$ and $R^3$ are both methyl. Preferably n is equal to 3.

In a preferred embodiment of the present invention, the compound of formula (I) is chosen in the group constituted of: erucic amidopropyl dimethyl betaine (EAPB), oleamidopropyl dimethyl betaine (OAPB), palmidopropyl dimethyl betaine (PAPB), and isostearamidopropyl dimethyl betaine (ISAPB).

More preferably, the compound of formula (I) is erucic amidopropyl dimethyl betaine (EAPB) or oleamidopropyl dimethyl betaine (OAPB). For optimum phase stability of these compositions, the neat pH, measured at 20 C, is ideally in the range of from 3 to 7. The pH of these compositions herein can be regulated by the addition of acids such as Bronsted or Lewis ones. Examples of suitable acids include the inorganic mineral acids, carboxylic acids, in particular the low molecular weight ($C_1$-$C_5$)-carboxylic acids, and alkylsulfonic acids. Suitable inorganic acids include HCl, $H_2SO_4$, $HNO_3$ and $H_3PO_4$. Suitable organic acids include formic, acetic, citric, methylsulfonic and ethylsulfonic acid. Preferred acids are citric, hydrochloric, phosphoric, formic, methylsulfonic acid, and benzoic acids. Especially preferred is citric acid.

The softening composition may also comprise other fabric softeners classically used, such as for example quaternary ammonium salts, particularly dialkyl quats or ester quats. Fabric softeners tend to be based on quaternary ammonium salts with one or two long alkyl chains, a typical compound being dipalmitoylethyl hydroxyethylmonium methosulfate. Other cationic compounds can be derived from imidazolium, substituted amine salts, or quaternary alkoxy ammonium salts. One of the most common compounds of the early formulations was dihydrogenated tallow dimethyl ammonium chloride (DHTDMAC). There are three main types of quaternary ammonium compounds used in the formulation of household fabric softeners: dialkyldimethyl ammonium compounds, diamido alkoxylated ammonium compounds, and imidazolinium compounds.

Softener that may be used in combination with the compound of formula (I) are preferably:

Preferred quaternary ammonium softeners of the present invention are: TET: Di(tallowcarboxyethyl)hydroxy ethyl methyl ammonium methylsulfate TEO: Di(oleocarboxyethyl)hydroxyethyl methyl ammonium methylsulfate, TES: Distearyl hydroxyethyl methyl ammonium methylsulfate, TEHT: Di(hydrogenated tallow-carboxyethyl)hydroxyethyl methyl ammonium methylsulfate, and TEP: Di(palmiticcarboxyethyl)hydroxy ethyl methyl ammonium methylsulfate In referring to other optional components, without this having to be regarded as an exhaustive description of all possibilities, which, on the other hand, are well known to the person skilled in the art, the following may be mentioned:

a) other products that enhance the performance of the softening compositions, such as silicones, amine oxides, anionic surfactants, such as lauryl ether sulphate or lauryl sulphate, amphoteric surfactants, such as cocoamidopropyl betaine or alkyl betaines, sulphosuccinates, polyglucoside derivatives, etc.

b) stabilising products, such as salts of amines having a short chain, which are quaternised or non-quaternised, for example of triethanolamine, N-methyldiethanolamine, etc., and also non-ionic surfactants, such as ethoxylated fatty alcohols, ethoxylated fatty amines, polysorbate, and ethoxylated alkyl phenols; typically used at a level of from 0 to 15% by weight of the composition.

c) products that improve viscosity control, for example inorganic salts, such as calcium chloride, magnesium chloride, calcium sulphate, sodium chloride, etc.; products which can be used to reduce viscosity in concentrated compositions, such as compounds of the glycol type, such as, ethylene glycol, dipropylene glycol, poly glycols, etc.; and thickening agents for diluted compositions, for example, polymers derived from cellulose, guar gum, etc.

d) components for adjusting the pH, which is preferably from 1.5 to 4.5, such as any type of inorganic and/or organic acid, for example hydrochloric, sulphuric, phosphoric, citric acid etc.

e) agents that improve soil release, such as the known polymers or copolymers based on terephthalates.

f) bactericidal preservative agents, g) other products such as antioxidants, colouring agents, perfumes, germicides, fungicides, anti-corrosive agents, anti-crease agents, opacifiers, optical brighteners, pearl lustre agents, etc.

The fabric softener according to the invention, may take a variety of physical forms including liquid, liquid-gel, paste-like, foam in either aqueous or non-aqueous form, powder, granular and tablet forms. For better dispersability, a preferred form of the composition is a liquid form, and in the form of an aqueous dispersion in water. When in a liquid form, the composition may also be dispensed with dispensing means such as a sprayer or aerosol dispenser.

When in a liquid form, such a fabric softener may contain from 0.1% to 20% by weight of a fabric softening agent, in the case of standard (diluted) fabric softener but may contain higher levels from up to 30% or even 40% by weight in the case of very concentrated fabric softeners. The composition will usually also contain water and other additives, which may provide the balance of the composition. Suitable liquid carriers are selected from water, organic solvents and mixtures thereof. The liquid carrier employed in the instant compositions is preferably at least primarily water due to its low cost, safety, and environmental compatibility. Mixtures of water and organic solvent may be used. Preferred organic solvents are; monohydric alcohol, such as ethanol, propanol, iso-propanol or butanol; dihydric alcohol, such as glycol; trihydric alcohols, such as glycerol, and polyhydric (polyol) alcohols.

Liquid fabric softeners are customarily prepared by melting the softening ingredients and adding the melt to hot water, with agitation to disperse the water-insoluble ingredients.

The fabric softener according to the invention can be used in a so-called rinse process, where a fabric softener as defined above, is first diluted in an aqueous rinse bath solution. Subsequently, the laundered fabrics which have been washed with a detergent liquor and optionally rinsed in a first inefficient rinse step ("inefficient" in the sense that residual detergent and/or soil may be carried over with the fabrics), are placed in the rinse solution with the diluted composition. Of course, the fabric softener may also be incorporated into the aqueous bath once the fabrics have been immersed therein. Following that step, agitation is applied to the fabrics in the rinse bath solution causing the suds to collapse, and residual soils and surfactant is to be removed. The fabrics can then be optionally wrung before drying.

Accordingly, there is provided a method for rinsing fabrics, which comprises the steps of contacting fabrics, preferably previously washed in a detergent liquor, with a softening composition or a fabric softener according to the invention. The subject-matter of the invention also includes the use of a fabric softener of the present invention to impart fabric softness to fabrics that have been washed in a high suds detergent solution, while providing in the rinse a reduction of suds or foaming and without the creation of undesirable floes.

The present invention also concerns a method for softening a fabric comprising contacting a softening composition of the invention during a rinse cycle of a fabric washing machine with an aqueous medium comprising said softening composition.

This rinse process may be performed manually in basin or bucket, in a non-automated washing machine, or in an automated washing machine. When hand washing is performed, the laundered fabrics are removed from the detergent liquor and wrung out. The fabric softener of the present invention may be then added to fresh water and the fabrics are then, directly or after an optional inefficient first rinse step, rinsed in the water containing the composition according to the conventional rinsing habit. The fabrics are then dried using conventional means.

The invention is further illustrated in the following non limiting examples.

EXPERIMENTAL PART

Material information:

Erucic amidopropyl dimethyl betaine (EAPB)

Oleamidopropyl dimethyl betaine (OAPB)

Palamidopropyl dimethyl betaine (PAPB)

Cocoamidopropyl dimethyl betaine (CAPB)

Di(hydrogenated tallow) dimethyl ammonium chloride (DHT)

Di(palmiticcarboxyethyl) hydroxyethyl methyl ammonium methylsulfate (TEP)

Fabrics that are tested in the experimental part are the following:

Broadcloth: 100% cotton fiber content/woven/Used for rewet method for water absorbency study Terry cloth: 100% cotton fiber content/looped file construction/Used for all of the other evaluation methods I. Pre Treatment, Drying and Softener Treatment Procedure:

1) Fabric Pretreatment Method

Washing machine model: ELBA EWF 625

Surfactant: SLS (28% active)

Dosage of detergent: 10.0 g/10 pieces of cotton towel (0.6 kg)

Washing mode: 1 main wash, 3 rinses, empty and 1 spin

Wash temperature: 25 C

2) Drying of Fabric

All fabric will be hanging dried in humidity room (Temp @20±1.0° C. and humidity @55±3%) for overnight to let fabric dry and equilibrate efficiently before further use.

3) Softener Treatment

Dosage of softener: 1.0 wt % Softener formulation (5.0 or other active %) in 150 ppm hard water Soaking time: 30 min Temperature: 25 C Non-rinsing and hanging dry in humidity room II. Results and Properties 1) Softness Results for softness comparisons by incline method are mentioned in Table 1, the shorter bending length, the better the softness.

TABLE 1

| Softener | Bending length (mm) |
|---|---|
| EAPB | 28.3 |
| PAPB | 29.6 |
| CAPB | 32.3 |
| DHT | 28.0 |
| TEP | 28.0 |

Incline method: Chinese National Standard Softener Evaluation Method GB/T 18318.1-2009 Textiles-determination of bending behavior-Part 1: Incline method.

Results for softness comparisons by sensorial test method with 6 panelists are mentioned in Table 2.

TABLE 2

| Softener | Average Value |
|---|---|
| EAPB | 3.6 |
| PAPB | 2.9 |
| CAPB | 1.0 |
| DHT | 4.3 |
| TEP | 4.0 |

Sensorial test method: revised ASTM D5237-05 standard guide for evaluating fabric softener. Blank was set as control with softness ranking of 0, which means the hardest. Another fabric was treated with another type of softener EAQ with softness ranking of 5 as a control, which means the softest.

It appears then that EAPB and PAPB provides equivalent or higher softness in comparison with compounds classically used in the softening compositions.

2) Water Absorbency

Results for water absorbency are mentioned in Table 3.

TABLE 3

| Softener | Water migration in height (mm) |
|---|---|
| EAPB | 64.0 |
| PAPB | 76.0 |
| OAPB | 80.5 |
| DHT | 9.0 |
| TEP | 53.5 |

Water absorbency ability evaluation by Rewet method: revised ASTM D5237-05 standard guide for evaluating fabric softener It appears then that EAPB and PAPB provides equivalent or higher water absorbency ability in comparison with compounds classically used in the softening compositions.

3) Fluffiness Evaluation

Results for fluffiness evaluation are mentioned in Table 4.

TABLE 4

| Softener | Flufiness (%) |
|---|---|
| EAPB | 28.7 |
| OAPB | 23.0 |

TABLE 4-continued

| Softener | Flufiness (%) |
|---|---|
| CAPB | 22.9 |
| DHT | 29.7 |
| TEP | 28.5 |

Softener treated fabric strips in certain size were stacked layer by layer. A light weight (100.0 g) and a heavy weight (550.0 g) were applied on top of the stacked layer of strips and the height of the stack of strips is measured after 15 seconds as T100 g and T550 g respectively. The bigger the difference of the stack height under light and heavy weight, the more fluffy the fabric strip is.

Fluffiness rating formulation:

$$\text{Fluffiness } \% = (T100\text{ g} - T550\text{ g})/T550\text{ g} * 100\%$$

Layer by layer method apparatus: Layer number: 15 layers/Sample Size: 50±1 mm in width and 80±1 mm in length/Light weight: 100.0 g weight standard/Heavy weight: 550.0 g weight standard.

It appears then that EAPB and OAPB provides equivalent or higher fluffness ability in comparison with compounds classically used in the softening compositions.

The invention claimed is:

1. A method for rinsing fabrics, the method comprising contacting the fabrics with a softening composition comprising at least a fabric softener compound of formula (I):

$$R^1\text{—}CONH(CH_2)_n\text{—}N^+(R^2R^3)\text{—}CH_2COO^- \quad (I)$$

wherein:

$R^1$ is $C_{22}$-alkyl or $C_{22}$-alkenyl, $R^2$ and $R^3$ are independently $C_1$-$C_4$-alkyl, and n is a number between 1 and 3; thereby softening the fabrics.

2. The method according to claim 1 wherein said composition comprises between 0.1% to 20% by weight of a fabric softener compound of said formula (I).

3. The method according to claim 1 wherein $R^1$ is $C_{22}$-alkyl.

4. The method according to claim 1 wherein $R^1$ is $C_{22}$-alkenyl.

5. The method according to claim 1 wherein the compound of said formula (I) is erucic amidopropyl dimethyl betaine (EAPB).

6. The method according to claim 1 wherein the pH of the composition is in the range of from 3 to 7.

7. The method according to claim 1 wherein the compound of said formula (I) is erucic amidopropyl dimethyl betaine (EAPB).

8. The method according to claim 1, wherein the fabrics are previously washed in a detergent liquor.

9. A method for softening a fabric, the method comprising contacting the fabric during a rinse cycle of a fabric washing machine with an aqueous medium comprising a softening composition comprising at least a fabric softener compound of formula (I):

$$R^1\text{—}CONH(CH_2)_n\text{—}N^+(R^2R^3)\text{—}CH_2COO^- \quad (I)$$

wherein:

$R^1$ is $C_{22}$-alkyl or $C_{22}$-alkenyl, $R^2$ and $R^3$ are independently $C_1$-$C_4$-alkyl, and n is a number between 1 and 3.

* * * * *